US011156030B2

(12) United States Patent
Boucher et al.

(10) Patent No.: US 11,156,030 B2
(45) Date of Patent: Oct. 26, 2021

(54) DOOR FOR A REFRIGERATED CABINET

(71) Applicant: AGC GLASS EUROPE, Louvain-la-Neuve (BE)

(72) Inventors: Nicolas M. Boucher, Gosselies (BE); Olivier Bouesnard, Ittre (BE); Pierre Schneider, Romagne (FR)

(73) Assignee: AGC GLASS EUROPE, Louvain-la-Neuve (BE)

( * ) Notice: Subject to any disclaimer, the term of this patent is extended or adjusted under 35 U.S.C. 154(b) by 0 days.

(21) Appl. No.: 15/757,493

(22) PCT Filed: Aug. 22, 2016

(86) PCT No.: PCT/EP2016/069774
§ 371 (c)(1),
(2) Date: Mar. 5, 2018

(87) PCT Pub. No.: WO2017/036832
PCT Pub. Date: Mar. 9, 2017

(65) Prior Publication Data

US 2018/0252022 A1 Sep. 6, 2018

(30) Foreign Application Priority Data

Sep. 3, 2015 (EP) ..... 15183726

(51) Int. Cl.
*E06B 3/663* (2006.01)
*E06B 3/02* (2006.01)
*E06B 3/30* (2006.01)

(52) U.S. Cl.
CPC ..... *E06B 3/66352* (2013.01); *E06B 3/66333* (2013.01); *E06B 3/02* (2013.01); *E06B 3/30* (2013.01)

(58) Field of Classification Search
CPC ..... E06B 3/66352; E06B 3/02; E06B 3/30; E06B 3/66333
See application file for complete search history.

(56) References Cited

U.S. PATENT DOCUMENTS 5,260,112 A 11/1993 Grether et al.
5,853,828 A 12/1998 Schimmelpenningh et al.
6,301,858 B1 * 10/2001 Crandell ..... E06B 3/66342 428/34
9,498,072 B2 * 11/2016 Artwohl ..... E05F 1/061
(Continued)

FOREIGN PATENT DOCUMENTS

CN 104508411 4/2015
CN 104583522 A 4/2015
(Continued)

OTHER PUBLICATIONS

EP2915460_Machine_translate (Year: 2015).*
(Continued)

*Primary Examiner* — Babajide A Demuren
(74) *Attorney, Agent, or Firm* — Oblon, McClelland, Maier & Neustadt, L.L.P.

(57) ABSTRACT

Door for a refrigerated cabinet, formed by multiple glazings that join a spacer frame, peripheral joints, and a reinforcement that makes it possible to do away with frame elements. The door comprises transparent vertical joints that connect the glass sheets of the glazing to transparent spacers.

24 Claims, 4 Drawing Sheets

(56) References Cited

U.S. PATENT DOCUMENTS

Figure 1:
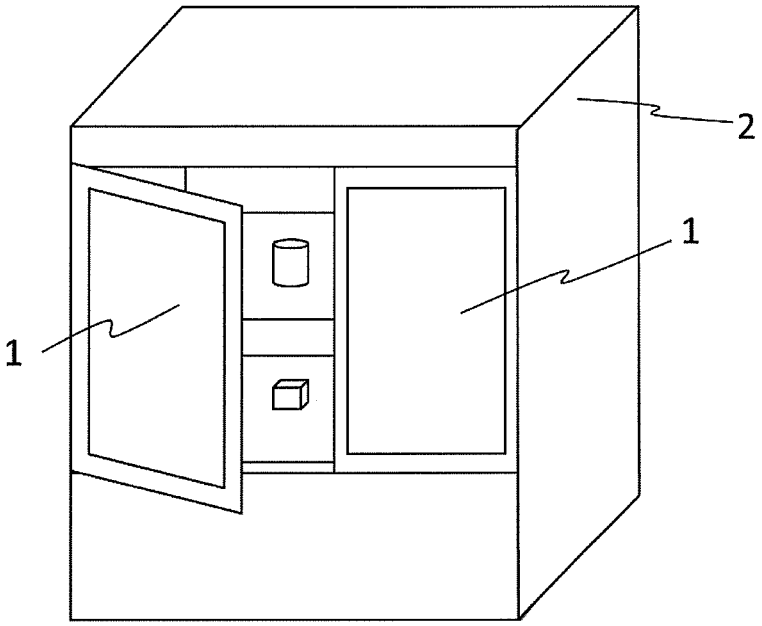

| | | | | |
|---|---|---|---|---|
| 10,240,388 | B2 * | 3/2019 | Artwohl | E06B 3/66309 |
| 2007/0178257 | A1 | 8/2007 | Landon | |
| 2007/0261359 | A1 * | 11/2007 | Buchanan | E06B 3/24 52/684 |
| 2015/0135627 | A1 | 5/2015 | Mottelet et al. | |
| 2015/0151511 | A1 | 6/2015 | Weiss | |
| 2015/0245720 | A1 | 9/2015 | Isfort et al. | |
| 2016/0120336 | A1 * | 5/2016 | Schneider | A47F 3/005 312/116 |
| 2016/0174734 | A1 * | 6/2016 | Artwohl | A47F 3/0434 428/34 |

FOREIGN PATENT DOCUMENTS

| | | | | |
|---|---|---|---|---|
| DE | 1011608 | B * | 7/1957 | C01C 1/242 |
| DE | 10 2011 009 879 | A1 | 8/2012 | |
| EP | 2878233 | A1 * | 6/2015 | |
| EP | 2 915 460 | A1 | 9/2015 | |
| EP | 3007594 | B1 * | 11/2018 | A47F 3/005 |
| TW | 351737 | B | 2/1999 | |
| TW | 200744969 | A | 12/2007 | |
| WO | WO-2015132071 | A1 * | 9/2015 | |
| WO | WO-2019076804 | A1 * | 4/2019 | E06B 3/66333 |

OTHER PUBLICATIONS

Third Party remarks issued in Application No. EP16754288.5 on Jan. 25, 2018 referencing DE 102011 009 879 A1.

European Third Party Observation issued Feb. 8, 2018 in European Patent Application No. 16754288.5, 3 pages.

International Search Report dated Nov. 4, 2016 in PCT/EP2016/069774 filed Aug. 22, 2016.

* cited by examiner

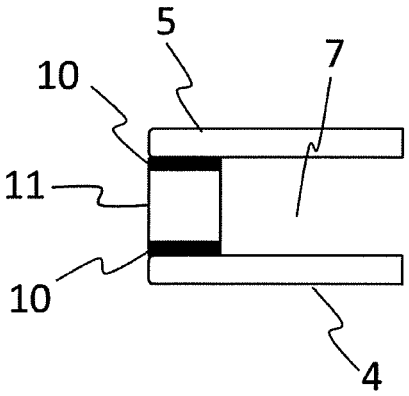
Figure 3: cross section AA
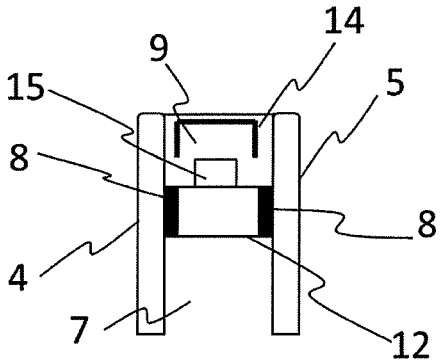
Figure 4: cross section BB
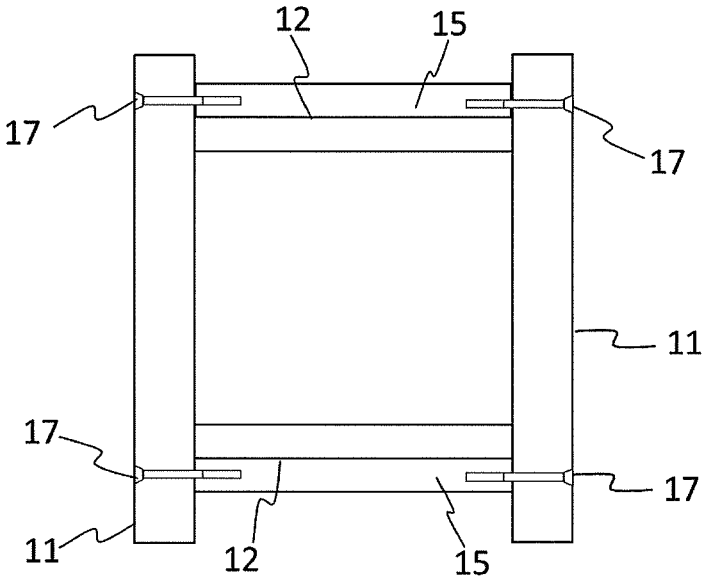
Figure 5

DOOR FOR A REFRIGERATED CABINET

1. FIELD OF THE INVENTION

The field of the invention is that of doors for a refrigerated chamber cabinet comprising insulating glazed elements. These doors may be used in applications such as refrigerator doors and freezer doors.

2. SOLUTIONS OF THE PRIOR ART

The refrigerated chamber cabinet, also referred to as a refrigerated cabinet, used in most commercial premises for offering for sale and/or consumption products that must be kept at temperatures below 10° C., such as foodstuffs, is often equipped with glazed elements that convert it into a refrigerated display cabinet. These cabinets allow the products to be viewed by the consumer/customer and in particular allow a self-service use while keeping the products at a given temperature. The refrigerated cabinet thus represents the last link in the food cold chain before the product comes into the possession of the consumer. The development of products and in particular of foodstuffs is of prime importance but this must not take place at the expense of the quality of their storage. In other words, the refrigerated cabinet is used to show and/or display the products in a net volume at a given storage temperature (in general below 10° C.).

Thus, the display of products and more particularly of foodstuffs has an essential role in the sale of these products. A good display has in particular a good visual access to the products contained in the refrigerated chamber cabinet, without having to open it. However, while displaying the products, the refrigerated chamber cabinet must maintain a certain temperature and ensure the preservation of the products that must be chilled or frozen. Thus, the cabinets must at the very least protect the products against thermal stresses of all sorts, such as the closing and opening of the doors. Technically speaking, the roles of displaying and preserving the products at a given temperature in refrigerated chamber cabinets are in complete contradiction since the consumer must be able to have available products contained in the refrigerated chamber cabinet while benefiting from a refrigerated chamber cabinet having a wide opening and that is well lit, and the storekeeper must ensure a storage quality of the products with, as a priority, the closure or the reduction of the openings of the cabinets as much as possible, the least lighting possible and more particularly the fewest heat exchanges with the store surroundings.

Thus, several solutions have been envisaged in order to improve the thermal insulation performance of these glazed elements used for the refrigerated chamber cabinets, such as the use of multiple glazings. However, the use of such multiple glazings in the doors of refrigerated chamber cabinets, due to their weight, generally requires the use of strong frameworks. Although these glazed elements and in particular their framework indeed carry out their mechanical role, they fall down on a considerable, both spatial and visual, bulkiness. In order to carry out their mechanical role, the materials used for producing the frameworks are usually of metallic nature, inducing a thermal bridge between the inside and outside of the refrigerated cabinet. This thermal bridge may give rise to the appearance of condensation on the framework and the door on the external side of the refrigerated cabinet.

Thus, document GB 2 162 228 discloses double glazing for a display case consisting of two glass sheets held in a parallel position and separated by spacers positioned between these sheets. The spacers contain a drying material and are completely or partly formed of transparent resinous material in order to allow good visibility of the merchandise kept in the display case and in order to prevent the formation of condensation on the inner surfaces of the glass sheets. Document GB 2 162 228 does not deal with the problem of reducing the visual and spatial bulkiness of the framework associated with the double glazing.

Patent application WO 2014/009244 A1 discloses a refrigerated cabinet door comprising at least two glass panels surrounded by framework elements on the horizontal and/or vertical edges. The framework elements give rise to the visual bulkiness and also a thermal bridge between the inside and outside of the refrigerated cabinet.

3. OBJECTIVES OF THE INVENTION

An objective of the invention is in particular to overcome these disadvantages of the prior art.

More specifically, one objective of the invention, in at least one of its embodiments, is to provide a refrigerated chamber cabinet door which can be fastened solidly and easily to the refrigerated cabinet.

Another objective of the invention, in at least one of its embodiments, is to provide a door for a refrigerated chamber cabinet that makes it possible to maintain the required temperature inside the refrigerated chamber cabinet while reducing the energy consumption in order to ensure effective preservation of the products contained in the refrigerated cabinet.

Another objective of the invention is to produce a refrigerated chamber cabinet door that meets the thermal insulation criteria for these types of cabinets and that offers a production that is easy to implement and economically advantageous. Thus, the use of transparent materials of polymer type and the elimination of the metal framework elements associated with the glazed elements makes it possible to offer an efficient solution from the point of view of the thermal insulation.

Another objective of the invention is to provide such a door that makes it possible to optimize the role of displaying the products contained in the refrigerated chamber cabinet while maintaining the energy efficiency. Specifically, the use of transparent elements makes it possible to provide a solution without visual interruption that would be due to an opaque vertical seal and/or an opaque vertical framework. The viewing of products intended for sale is therefore improved thereby.

Another objective of the invention is to provide a refrigerated chamber cabinet door that meets the mechanical strength criteria for these types of cabinets. Thus, the mechanical elements that enable in particular the opening of the door are incorporated directly into the glazing and replace the framework elements that surround known glazings. Another advantage lies in the fact that, from the mechanical point of view, the door for a refrigerated chamber cabinet according to the invention is also capable of withstanding high mechanical stresses such as several hundreds of thousands of opening/closing cycles without requiring the use of framework elements present in combination with the glazing of a traditional door.

Another objective of the invention is to be able to be implemented on refrigerated cabinets already in service in order to enable them to meet the current energy efficiency criteria of cabinets of this type via an easy and economically advantageous implementation of the invention.

4. SUMMARY OF THE INVENTION

The invention relates to a door of a refrigerated chamber cabinet comprising:

a. at least one insulating multiple glazing formed of at least one first glass sheet and one second glass sheet which are joined together by means of a spacer frame which holds them at a certain distance from one another, said frame extending along the horizontal and vertical edges of the glazing, b. between said at least two glass sheets, at least one internal space comprising an insulating gas, that is closed by at least one first peripheral seal and one second peripheral seal on the horizontal edges and at least one peripheral seal on the vertical edges, said peripheral seals being positioned around said internal space, the spacer frame comprising at least two vertical spacers and at least two horizontal spacers, at least one vertical spacer being made of transparent resin, at least one vertical peripheral seal being transparent, the horizontal spacers being composed of at least one profile, according to which a) the spacers are connected together in order to form said spacer frame, b) at least one fastening system attaching the door to the chamber cabinet is at least partially inserted in at least one horizontal peripheral seal, c) the door comprises a reinforcement, attached to the fastening system and inserted at least partially in at least one horizontal peripheral seal, d) the spacer frame, the peripheral seals and the reinforcement replace the framework of a traditional door and fulfill its functions.

The general principle of the invention is based on the use and the combination of a spacer frame, peripheral seals and a reinforcement that makes it possible to do without the framework element of traditional doors and to fulfill their functions which are: possible opening and holding of the glazing.

According to the invention, the term "door" is understood to denote a system for opening/closing the cabinet and, by extension, the opening part of the cabinet only. The system may equally well comprise a movement of rotational or rectilinear type, or a combination of the two.

A traditional door is a door comprising a framework and a glazing. The framework encompasses the whole or a portion of the periphery of the glazing, it is formed of framework elements that carry out the functions of opening, holding and supporting the glazing.

The refrigerated chamber denotes a closed space delimited in part by the door and in which a temperature lower than the temperature of the atmosphere around the cabinet prevails.

Multiple glazing is understood to mean glazing comprising at least two glass sheets. Preferably, the multiple glazing is a double glazing or triple glazing. More preferably, it is a double glazing comprising two glass sheets.

The glass of the sheets of the glazing is a glass from the category of soda-lime-silica glasses well known in window applications. The thickness of the glass sheets generally lies in the range extending from 0.5 to 15 mm. In the case of a triple glazing, the central sheet generally has a smaller thickness than the two other sheets.

An insulating multiple glazing denotes a multiple glazing that limits the heat exchanges between the refrigerated chamber and the atmosphere around the cabinet.

According to the invention, the glass sheets are joined together by means of a spacer frame. The spacer frame denotes a rigid element positioned between the glass sheets, which holds them at a certain distance and which extends along the horizontal and vertical edges of the glazing. The spacer frame also has the role of contributing to the stiffening of the door. The spacer frame according to the door in accordance with the invention has the shape of a quadrilateral, preferably a parallelogram. More preferably still, the quadrilateral is a rectangle or a square.

The adjectives vertical and horizontal are understood to denote locations close to opposite edges, that is to say non-contiguous edges of the frame and/or of the glazing, and which are facing each other.

According to the invention, the door comprises an internal space between the glass sheets. The internal space is bordered by the spacer frame and filled with a gas. The gas of the internal space is an inert gas capable of thermally insulating the glazing. A suitable inert gas is chosen for its absence of toxicity to living beings, of corrosive nature with regard to the glazing, of flammable nature and of sensitivity to UV radiation. Such a gas is generally chosen from air, argon, xenon, krypton and their mixtures. Generally, use will be made of air, argon or a mixture of air and argon.

According to a preferred embodiment of the invention, the internal space comprises an insulating gas comprising at least 85% of argon.

In the door according to the invention, peripheral seals are seals positioned around the internal space, providing the tightness and contributing to the mechanical strength of the door. At least one first peripheral seal and one second peripheral seal are located on the horizontal edges of the door. The first of these two seals is always a double seal connecting the horizontal spacer to each glass sheet. Similarly, at least one peripheral seal is located on the vertical edges. The latter seal is also a double seal connecting the vertical spacer to each glass sheet.

At least one vertical spacer of the spacer frame is formed from a transparent resin. The term "transparent" denotes a property illustrating the percentage $T_L$ (light transmission) of visible light transmitted through the glazing in the visible spectrum of at least 1%. Preferably, transparent relates to a $T_L$ property of at least 10%. Ideally, transparent denotes a $T_L$ of at least 50%.

At least one peripheral seal on at least one vertical edge is also transparent.

The horizontal spacers are composed of at least one profile. "Profile" is understood to denote an object of elongated shape and of constant cross section. The profile is generally made of metal, of polymer, of ceramic or of composite material (combination of at least two different materials). The profile is preferably a solid profile and is mainly composed of a polymer matrix. Desiccative material may be incorporated into the polymer matrix. An example of such a desiccative polymer is a polymer comprising an integrated molecular sieve.

It is also possible to use hollow profiles. In this case, the desiccative material will at least partially fill the hollow space. Examples of desiccative materials capable of filling the hollow space are silica gels and molecular sieves.

In the door according to the invention, the spacer frame is composed of at least two vertical spacers and of at least two horizontal spacers.

At least one fastening system attaches the door according to the invention to the refrigerated chamber cabinet and is at least partially inserted in at least one horizontal peripheral seal. The fastening system is a device that enables the attachment of the door to the chamber cabinet.

According to the invention, the fastening system is composed of at least one screw having a function different from that of the spacer frame described below. According to one particular embodiment of the invention, the fastening system is composed of two screws, a plate equipped with a pivot and drilled with two holes into which the two screws are inserted. Preferably, the fastening system also comprises a self-closing system and a system that limits the opening of the door.

The door comprises a reinforcement, attached to the fastening system and inserted at least partially in at least one horizontal peripheral seal. "Reinforcement" is understood to mean a mechanical element that has the role of at least partly absorbing the mechanical stresses induced by the weight of the door and the forces for opening and closing this door. The reinforcement of the door according to the invention is generally in the form of a profile, different from the profile used for the horizontal spacers. The cross section of this profile may generally be U-shaped or L-shaped. The material of the profile may be a metal, a polymer or a composite material. Examples of attachment are screws, clips, welds, adhesive bonds and pressure closing systems.

In the door according to the invention, the spacer frame, the peripheral seals and the reinforcement replace the framework of traditional doors and also fulfill its functions.

According to a first particular embodiment of the invention, the vertical spacers of the spacer frame of the door are connected to the horizontal spacers by means of a stiffening element. Generally, a "stiffening element" should be understood as meaning the combination of at least one metal, polymeric, ceramic or composite material part with a pressure device, an adhesive, a pin, a screw or any other means providing bonding between said spacers. In certain variants of this first embodiment, the stiffening element comprises the combination of a metal, polymeric, ceramic or composite material part with one means providing bonding with the spacers. In other variants of this first embodiment, the stiffening element comprises the combination of a metal, polymeric, ceramic or composite material part with several means providing bonding with the spacers.

The adhesive may be selected from crosslinkable acrylic polymer glues, crosslinkable epoxy glues, double-sided adhesive tapes made of acrylic polymer and polyisobutylene-based adhesives. The screw may be made of steel, of zinc-coated steel, of stainless steel or of bronze. According to one particular embodiment of the invention, the stiffening element is formed of a profile different in nature and/or in shape from the horizontal spacer. Another variant consists also in combining the horizontal spacer with pieces of profiles positioned non-continuously, forming blocks which make up the stiffening element.

According to a variant of this first embodiment, the stiffening element is composed of at least one part that is attached to at least one reinforcement. The term "attached" is understood to denote an assembly that does not allow any degree of freedom between the two parts. Examples of attachment are screws, clips, welds, adhesive bonds and pressure closing systems. Preferably, the attachment will be made using screws or adhesive bonds.

According to this variant of the first embodiment, the reinforcement may even extend along the horizontal spacer and be used itself as stiffening element. The reinforcement is then a profile of square or rectangular cross section which is attached to the horizontal spacer by an adhesive bond, a pressure system, a weld, a clip or any other element that enables this attachment.

According to a second variant of the first embodiment of the invention, the stiffening element is in contact with at least the second horizontal peripheral seal. According to the concrete form adopted for the stiffening element, the contacting operation is carried out over a portion only or over the whole of the external surface of this element. For example, in the case of a profile with a square or rectangular cross section, this profile could be immersed completely in the second horizontal peripheral seal.

According to a second particular embodiment of the invention, compatible with the first embodiment, the fastening system emerges from the horizontal peripheral seal and extends into at least one of the following parts:

a stiffening element, a horizontal spacer.

Preferably, a second screw that is part of the fastening system passes through the second horizontal peripheral seal and also the reinforcement, and extends into the stiffening element that has a shape suitable for receiving the screw.

According to another embodiment of the invention that is compatible with the previous ones, the second horizontal peripheral seal is a mastic having a structural function, such as silicone, polyurethane (PU), polysulfides and modified silicone (MS-Polymer). These mastics have a very good mechanical strength, in addition to their properties of watertightness and airtightness and of adhesion to the glass. This second peripheral seal is also known as sealing seal. "Structural function" is understood to mean the ability to transfer the mechanical stresses related in particular to the weight of the glass sheets, to the thermal expansion stresses and also to the opening-closing movements.

According to one advantageous implementation of the invention, the transparent spacer is formed from a transparent resin that is rigid at ambient temperature comprising a polymer selected from a polymethyl methacrylate (PMMA), a polycarbonate (PC), a polystyrene (PS), a polyvinyl chloride (PVC), a polyamide (PA), a polyetherimide (PEI), a polyethylene terephthalate (PET), a styrene-acrylonitrile copolymer (SAN), copolymers thereof or a mixture of these compounds. Preferably, the transparent spacer is formed from PMMA or polycarbonate due to their high transparency and their ease of processing. The term "polymer" covers in this instance both polymers and copolymers.

The expression "resin that is rigid at ambient temperature" is understood to denote a resin that has, at ambient temperature, a longitudinal elastic modulus (Young's modulus) of greater than 1.0 GPa and preferably greater than 1.5 GPa. Most preferably, the rigid resin has a Young's modulus of greater than 2.0 GPa.

According to the invention, the transparent vertical peripheral seal is formed from a transparent adhesive resin that is flexible at ambient temperature chosen from a polyisobutylene-based adhesive, a double-sided tape made of acrylic polymer, of rubber or of silicone more commonly known by the name "double-sided adhesive tape of pressure-sensitive adhesive (PSA) or transfer tape type".

The combination of rigid vertical spacers and of a flexible seal makes it possible to obtain a door capable of withstanding repeated mechanical stresses such as several hundreds of thousands of opening/closing cycles.

Alternatively to this flexible transparent resin, it is also possible to use a crosslinkable adhesive of acrylic or epoxy type. In this case, it is used in liquid or pasty form and the adhesive is crosslinked in situ between the glass sheet and the vertical spacer.

"Crosslinkable" is understood to mean the fact of forming in situ a three-dimensional network of polymer chains under the action of ultraviolet radiation, of moisture or of a curing agent. These materials, in addition to being transparent, exhibit a good performance in terms of tightness to water vapor and to gases and in addition exhibit good adhesion to the glass while withstanding ultraviolet rays.

Preferably, the transparent vertical peripheral seal is formed from a transparent adhesive resin that is flexible at ambient temperature as described above.

The first horizontal peripheral seal is formed of a polyisobutylene-based mastic, more commonly referred to as butyl mastic, or of a double-sided tape made of acrylic polymer, of rubber or of silicone, or of a combination of the two. This type of seal is particularly effective in terms of tightness to water vapor and to gases.

The use of insulating multiple glazings makes it possible to optimize the energy efficiency of the refrigerated chamber cabinet. The thermal insulation is usually determined by the overall performance qualities of a glazed element as multiple glazing, which are defined by Ug, the heat transfer coefficient of the glazing (calculated according to the EN 673 and ISO 10292 standards). "Heat transfer coefficient Ug" is understood to mean the amount of heat passing through the glazing, under steady-state conditions, per unit of surface area, for a difference of one degree Celsius between the surroundings, for example exterior and interior. Several factors can improve this Ug coefficient, for example layers of low-e type deposited on the glass sheets and, preferably, on their interior faces, that is to say the faces in contact with the gas-filled space. Another factor is the nature of the insulating gas. For example, the glass sheets used may be coated with one or more metal layers, for example the TopN® or TopN+T® layers (AGC registered trademarks). The TopN+T® layers are preferred. According to an advantageous implementation of the invention, compatible with all the preceding implementations, the insulating glazing has a heat transfer coefficient Ug of at least 0.3, preferably of at least 0.6 and most preferably of at least 1.0 $W/m^2$. The heat transfer coefficient Ug is generally of at most 1.8 $W/m^2$.

According to another particular implementation of the invention, it too being compatible with the preceding implementations, a primer layer is positioned at least between:

the transparent seal and the vertical spacer, the transparent seal and the glass sheet.

Preferably, a primer layer is positioned both between the transparent seal and the vertical space and between the transparent seal and the glass sheet.

The term "primer layer" is understood to denote a layer of an organic product which adheres well to the peripheral seal and which has selective adhesive properties with respect to the glass or the transparent resin of which the spacer is made. Examples of such primers are based on compounds of the family of silanes and compounds of the family of acrylic resins. "Good adhesion" is understood to mean an adhesion which requires a positive tear-off force in order to separate the two assembled parts and for which the failure of the two parts together is cohesive, as described in EN 1279 Part 4 standard.

A primer which has given excellent results is the primer VHB AP115® from 3M.

According to yet another advantageous embodiment of the invention, itself also compatible with the preceding embodiments, the reinforcement may be a rectangular or curved, closed or open profile of U-shaped or L-shaped cross section, which is inserted, at least partly, in the second peripheral seal. Preferably, the profile has a U-shaped or L-shaped cross section. The profile may be made of steel, stainless steel or polymer material. Preferably, the profile is made of stainless steel for its excellent stiffness and the absence of any corrosion. It generally has the same length as the horizontal spacer. It is at least partly inserted in the second peripheral seal and bears against this horizontal spacer.

According to one particular embodiment of the invention, still compatible with the other embodiments, the insulating glazing comprises at least one first glass sheet and one second glass sheet which are joined by means of the spacer frame, said sheets being of different sizes and possibly therefore being offset over some or all of the periphery of the glazing. This is then referred to as asymmetric or stepped glazing. This difference in size between the first and second glass sheets has the advantage of facilitating the insertion of a reinforcement and of a fastening system. The advantage here is to also permit translational opening/closing systems (sliding doors). Another advantage of this particular embodiment of the invention is to enable the placement of a heating network which could be deposited on the offset portion of the glass in order to avoid the appearance of condensation at the edge of the glazing.

Advantageously, the invention also relates to a door, at least one glass sheet of which is partially covered with a decorative layer chosen from ceramic inks and organic inks. Preferably, the decorative layer is an opaque ceramic ink, more commonly known as enamel, which masks the spacer frame and also the peripheral seals. Generally, the enamel is applied by screen printing on one of the faces of at least one glass sheet. Preferably, the enamel layer is applied to the glass sheet which is oriented toward the outside of the refrigerated chamber.

More advantageously still, the fastening system is masked by the decorative layer deposited on the glass sheet.

Most advantageously, an enamel layer is deposited on the offset surface of the glazing and makes it possible to hide the fastening system from the view of an external observer.

In the door in accordance with the invention, it is possible, for safety reasons, for the glass sheets to be tempered glass sheets or laminated glass sheets. The latter sheets comprise a stack of at least one sheet made of polyvinyl butyral (PVB) plastic sandwiched between two glass sheets. Such stacks of laminated glasses are provided with total glass thicknesses (not including the thickness of the PVB sheet(s)) ranging from 4 mm up to and including 24 mm.

According to one advantageous implementation of the invention, the stiffening element has a form of a profile extending over the entire length of at least one horizontal spacer. Preferably, the stiffening element is a profile with a square or rectangular cross section. More preferably, it is glued to the horizontal spacer using a double-sided acrylic adhesive tape.

In the door in accordance with the invention, the reinforcement may also be an integral part of the horizontal spacer.

In another embodiment of the invention, still compatible with the other embodiments, the horizontal spacer may be a profile composed of two chambers. The first chamber borders the internal space of the glazing and the second chamber is in contact with the second peripheral seal and acts as reinforcement. More preferably, the second chamber may be hollow and have a cross section comparable to the first chamber. Most preferably, the first chamber may also be hollow and contain the desiccative material.

In order to further improve the tightness of the door, a second transparent vertical peripheral seal may advantageously be added so that it is contiguous with the following elements:

a. the transparent vertical peripheral seal;

b. the transparent vertical spacer;

c. the two glass sheets.

The nature of this second seal is preferably chosen from the same materials as those of the transparent vertical peripheral seal already described above. It is however important for the material of each of the two seals to be of different nature.

5. LIST OF THE FIGURES

Other features and advantages of the invention will become more clearly apparent on reading the following description of one preferred embodiment, given by way of simple illustrative and nonlimiting example, and from the appended drawings, in which:

FIG. 1 illustrates the refrigerated chamber cabinet (2) comprising doors (1) in accordance with the invention.

Figure 2:
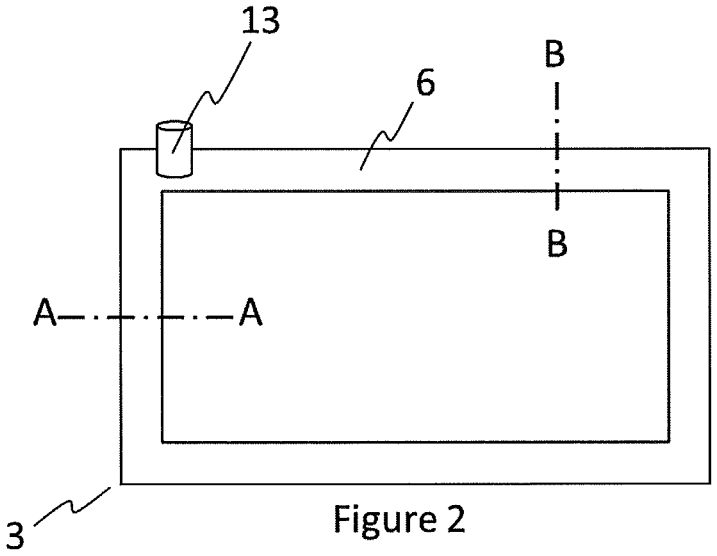

FIG. 2 schematically illustrates the door (1) of a refrigerated chamber cabinet (2) comprising an insulating multiple glazing (3), the associated spacer frame (6) and the fastening system (13) of the door (1) according to the invention.

FIG. 3 is a cross-sectional view along AA in the vertical edge of a multiple glazing of the door from FIG. 2. This cross-sectional view represents the following elements: the glass sheets (4, 5), the internal space (7), the double transparent vertical peripheral seal (10) and the transparent vertical space (11).

FIG. 4 is a cross-sectional view along BB in a horizontal edge of a multiple glazing of the door from FIG. 2. This cross-sectional view represents the following elements: the glass sheets (4, 5), the internal space (7), the first horizontal peripheral seal (8), the second horizontal peripheral seal (9), the horizontal spacer (12), the reinforcement (14) and the stiffening element (15) which here is a profile of rectangular cross section.

FIG. 5 illustrates the spacer frame (6) of the glazing of the door according to one embodiment of the invention. The figure depicts the following elements: the transparent vertical spacers (11), the horizontal spacers (12), the stiffening elements (15) and the screws (17) making the connection between the transparent vertical spacers (11) and the stiffening elements (15).

Figure 6:
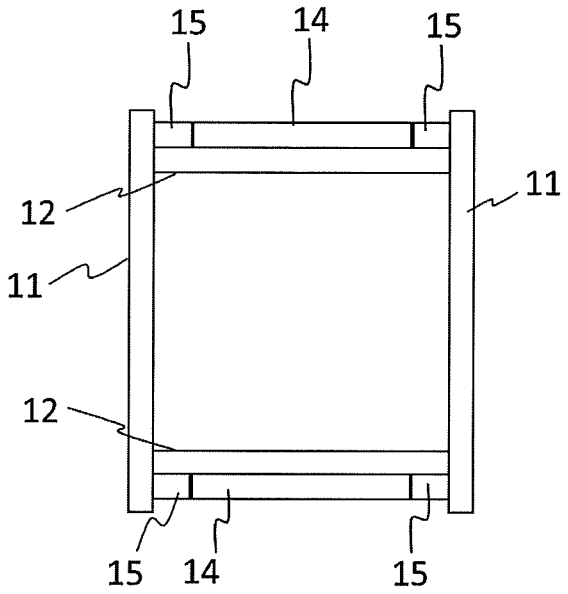

FIG. 6 illustrates the spacer frame (6) according to another embodiment of the glazing of the door according to the invention. The figure depicts the following elements: the transparent vertical spacers (11), the horizontal spacers (12), the stiffening elements (15) and the reinforcements (14). In this embodiment, the stiffening elements (15) are connected to the vertical spacers (11) by means of a polyisobutylene-based mastic. It is also possible to add screws (not represented in the figure) in order to perfect the connection.

Figure 7:
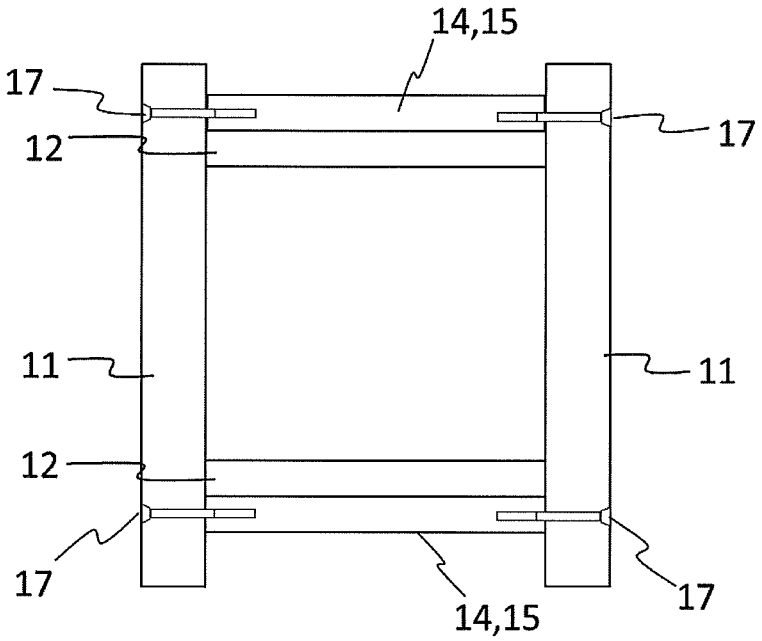

FIG. 7 illustrates the same spacer frame according to yet another embodiment of the invention. The figure depicts the following elements: the transparent vertical spacers (11), the horizontal spacers (12), the stiffening elements (15) that also take on the role of reinforcements (14) and the screws (17) making the connection between the transparent vertical spacers (11) and the stiffening elements and reinforcements (15, 14).

Figure 8:
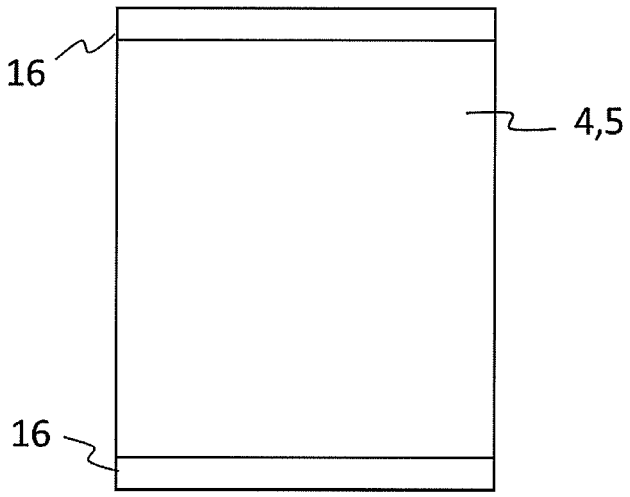

FIG. 8 illustrates a front view of a glass sheet (4) or (5) with a decorative layer made of enamel (16) according to one particular embodiment of the invention.

Figure 9:
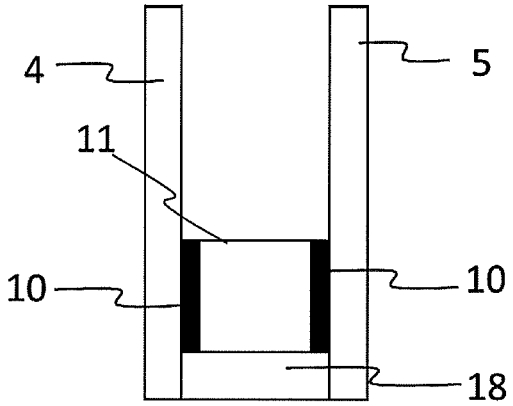

FIG. 9 is a figure analogous to FIG. 3 where a second transparent vertical peripheral seal (18) sits on top of the first seal (10). This figure is a cross-sectional view along AA in the vertical edge of the door from FIG. 2. It is seen that this seal (18) is contiguous with the first double seal (10) and also with the transparent vertical spacer (11) and with the two glass sheets (4, 5).

6. DESCRIPTION OF EMBODIMENTS OF THE INVENTION

Example 1

A door (1) according to the invention was produced which could be mounted on the refrigerated cabinet (2).

The door (1) is a double glazing (3) comprising a first sheet (4) and a second sheet (5) of soda-lime-silica type glass with dimensions of 1700 mm×600 mm and each having a thickness of 4 mm. The glass sheets (4) and (5) were then tempered.

These glass sheets (4, 5) were joined by means of a spacer frame (6) which holds them at a certain distance from one another. The spacer frame (6) was formed of two Super Spacer® horizontal spacers (12) from Edgetech and of two transparent vertical spacers (11) made of PMMA as illustrated in FIG. 5 The sizing of the horizontal spacers (12) is the following: length 580 mm×thickness 14 mm×height 7 mm. The sizing of the vertical spacers (11) is the following: length 1700 mm×thickness 12 mm x height 10 mm. The desiccative material is incorporated into the matrix of the Super Spacer® spacer.

At each glass sheet (4, 5)/horizontal spacer (12) interface, a 1 mm thick bead of polyisobutylene was placed over the entire length of the horizontal spacers (12) as FIG. 4 illustrates. This bead of polyisobutylene takes on the role of first double horizontal peripheral seal (8). Similarly, at each glass sheet (4, 5)/transparent vertical spacer (11) interface, a seal in the form of 3M VHB® 4918 double-sided acrylic adhesive tape having a thickness of 2 mm and a height of 10 mm was deposited over the entire length of the vertical spacers (11) as FIG. 3 illustrates. In order to increase the adhesion between the acrylic adhesive and the glass sheet, a 3M® AP 115 silane-type primer was deposited at each interface.

Two polymer profiles, used as stiffening elements (15), were glued to the upper portion of each horizontal spacer (12) (see FIG. 5) using a 1 mm thick 3M VHB® double-sided acrylic adhesive tape. The sizing of each profile was the following: length 580 mm, thickness 8 mm, height 8 mm. The distance between the end of the transparent vertical spacers (11) and the upper edge of the stiffening element (15) was 10 mm. As illustrated in FIG. 5, the screws (17) make the connection between the transparent vertical spacers (11) and the stiffening elements (15).

Between the two glass sheets (4, 5), an internal space (7) comprising an insulating gas of argon type is closed off by the spacer frame (6). The concentration of argon is 85%.

As FIG. 4 illustrates, a second horizontal peripheral seal (9) of Dow Corning® 3362 silicone (referred to in the remainder of the text as "silicone seal"), was placed along the horizontal edges, and is contiguous with the horizontal spacers (12), with the first horizontal peripheral seal (8) and with the two glass sheets (4, 5). The stiffening element (15) was also immersed in the silicone seal (9).

As FIG. 4 also illustrates, a U-shaped profile, having the role of reinforcement (14), is inserted in the silicone seal (9). The reinforcement (14) is made of stainless steel and extends along the horizontal spacer (12). A fastening system (13) was partly inserted in the second horizontal peripheral seal (9) and also in the reinforcement (14). The fastening system (13) was composed of the following elements: two 5 mm diameter screws, and a pivot part contiguous with the silicone seal (9) and equipped with two holes where the two screws are inserted. The screws are also inserted into the silicone seal (9) and the U-shaped profile (14). This fastening system (13) has made it possible to attach the door (1) to the refrigerated cabinet (2).

Example 2

Effect of a Primer

Materials:

Rectangular plates of soda-lime-silica float glass with a thickness of 4 mm and with dimensions of 65 mm×25 mm.

3M VHB® 4918 double-sided transparent-type tape manufactured by 3M.

3M® AP 115 transparent silane-type primer sold by 3M.

Test Specimens with Primer:

Two test specimens were produced, each from two rectangular plates of soda-lime-silica float glass, one of which had previously been coated (on one face) with a TopN+T low-e layer.

One of the two faces of the non-precoated plate and the precoated face of the second plate are cleaned using isopropanol. The primer is then applied to the cleaned surfaces under a controlled atmosphere at a temperature of 25° C. and 50% relative humidity (RH). The primer dries for 2 to 3 minutes before applying a 25×10 mm strip of tape transversely to one of the glass plates so as to cover its entire width in a central position of the plate while avoiding the formation and trapping of any air bubble between the tape and the glass plate. The second glass plate is then glued in its central position to the other face of the tape already glued to the first glass plate so that the glass plates together form an angle of 90°. A glass/low-e layer/primer/double-sided tape/primer/glass stack was thus produced.

Reference Test Specimens:

Two reference test specimens were produced in a similar manner, omitting the step of applying the primer. A glass/low-e layer/double-sided tape/glass stack was thus produced.

Evaluation

One reference test specimen and one test specimen with primer were placed in a chamber under a controlled atmosphere at a temperature of 70° C. and 100% RH for 336 hours.

One reference test specimen and one test specimen with primer were not subjected to this conditioning.

The 4 test specimens were then subjected to a mechanical test consisting in placing the two glass plates of each test specimen under tension. The test was carried out under controlled atmosphere at a temperature of 25° C. and 50% RH. The tension was exerted in a direction perpendicular to the surface of each of the 2 glass sheets and the tensile force needed to give rise to the tearing-off and the complete separation of the two plates was measured.

The results obtained are given in Table 1:

TABLE 1

| Test specimen | Tear-off force (N) Without conditioning | With conditioning |
|---|---|---|
| Reference | >30 | 0 (adhesive failure) |
| With primer | >30 | >20 |

The failure is of cohesive type within the material of the tape, except in the case of the sample without primer that underwent conditioning. The latter has a delamination phenomenon of the adhesive starting from the conditioning phase and gives rise to adhesive failure at the interface between the glass coated with the low-e layer and the tape.

The test specimen produced according to the particular variant of the invention has an increased aging resistance performance relative to a reference test specimen.

The invention claimed is:

1. A door of a refrigerated chamber cabinet comprising:

a. at least one insulating multiple glazing formed of at least one first glass sheet and one second glass sheet which are joined together by a spacer frame which holds them at a certain distance from one another, said frame extending along horizontal and vertical edges of the glazing, b. between said at least two glass sheets, at least one internal space comprising an insulating gas, that is closed by at least one first peripheral seal and one second peripheral seal on the horizontal edges and at least one peripheral seal on the vertical edges, said peripheral seals being positioned around said internal space, the spacer frame comprising at least two vertical spacers and at least two horizontal spacers, at least one vertical spacer being made of transparent resin, at least one vertical peripheral seal being transparent, the horizontal spacers being composed of at least one profile, wherein:

a) the spacers are connected together in order to form said spacer frame, b) at least one fastening system attaching the door to the chamber cabinet, the fastening system being at least partially inserted in at least one horizontal peripheral seal, c) the door comprises a reinforcement, attached to the fastening system and inserted at least partially in at least one horizontal peripheral seal, d) the spacer frame, the peripheral seals and the reinforcement hold the glass sheets together, and e) the door does not have a framework on a perimeter of the glass sheets.

2. The door according to claim 1, wherein the vertical spacers are connected to the horizontal spacers by at least one stiffening element.

3. The door according to claim 2, wherein the stiffening element is attached to at least one reinforcement.

4. The door according to claim 2, wherein the reinforcement and the stiffening element are the same element.

5. The door according to claim 2, wherein the stiffening element is in contact with at least the second horizontal peripheral seal.

6. The door according to claim 1, wherein the fastening system extends into at least one of the following parts:

a. a stiffening element, or b. a horizontal spacer.

7. The door according to claim 1, wherein the second peripheral seal is a mastic having a structural function, selected from the group consisting of silicones, polyurethanes, polysulfides and modified silicones.

8. The door according to claim 1, wherein the transparent resin comprises a polymethyl methacrylate, a polycarbonate, a polystyrene, a polyvinyl chloride, a polyamide, a polyetherimide, a polyethylene terephthalate, a styrene-acrylonitrile copolymer, copolymers thereof or a mixture of one or more of these compounds.

9. The door according to claim 1, wherein the transparent vertical peripheral seal is:

a. a double-sided tape:

i. made of acrylic polymer, ii. made of rubber, or iii. made of silicone, b. a polyisobutylene-based adhesive, or c. an adhesive of crosslinkable acrylic or crosslinkable epoxy type.

10. The door according to claim 1, wherein the first horizontal peripheral seal is formed of a polyisobutylene-based mastic or of a double-sided tape made of acrylic polymer, of rubber or of silicone, or of a combination of the two.

11. The door according to claim 1, wherein the fastening system is formed of at least one screw.

12. The door according to claim 1, wherein the glazing has a heat transfer coefficient Ug ranging from 0.3 to 1.8 $W/m^2$.

13. The door according to claim 1, wherein a primer layer is positioned between at least:

a. the transparent seal and the vertical spacer, or b. the transparent seal and the glass sheet.

14. The door according to claim 2, wherein the stiffening element is connected to the vertical spacers and/or horizontal spacers by at least one of the following elements:

a. a screw made of steel, of zinc-coated steel, of stainless steel or of bronze, or b. an adhesive selected from polyisobutylene-based mastics, crosslinkable acrylic polymer glues, crosslinkable epoxy glues, double-sided adhesive tapes made of acrylic polymer.

15. The door according to claim 1, wherein the reinforcement has a form of a profile and is, at least partly, inserted in the second peripheral seal.

16. The door according to claim 1, wherein one of the glass sheets is stepped relative to the other glass sheet.

17. The door according to claim 1, wherein at least one glass sheet is partially covered with a decorative layer selected from the group consisting of ceramic inks and organic inks.

18. The door according to claim 17, wherein the fastening system is masked by the decorative layer deposited on the glass sheet.

19. The door according to claim 1, wherein the glass sheets are tempered and/or laminated.

20. The door according to claim 2, wherein the stiffening element has a form of a profile extending over the entire length of at least one horizontal spacer.

21. The door according to claim 1, wherein the reinforcement is an integral part of the horizontal spacer.

22. The door according to claim 1, wherein a second transparent vertical peripheral seal is contiguous with the following elements:

a. the transparent vertical peripheral seal;

b. the transparent vertical spacer; and c. the two glass sheets.

23. A door of a refrigerated chamber cabinet comprising:

a. at least one insulating multiple glazing formed of at least one first glass sheet and one second glass sheet which are joined together by a spacer frame which holds them at a certain distance from one another, said frame extending along horizontal and vertical edges of the glazing, b. between said at least two glass sheets, at least one internal space comprising an insulating gas, that is closed by at least one first peripheral seal and one second peripheral seal on the horizontal edges and at least one peripheral seal on the vertical edges, said peripheral seals being positioned around said internal space, the spacer frame comprising at least two vertical spacers and at least two horizontal spacers, at least one vertical spacer being made of transparent resin, at least one vertical peripheral seal being transparent, the horizontal spacers being composed of at least one profile, wherein:

a) the spacers are connected together in order to form said spacer frame, b) at least one fastening system attaching the door to the chamber cabinet, the fastening system being at least partially inserted in at least one horizontal peripheral seal, c) the door comprising a reinforcement, attached to the fastening system, and inserted at least partially in at least one horizontal peripheral seal, and the door is devoid of a framework of a traditional door which is replaced by the spacer frame, the peripheral seals and the reinforcement that fulfil the functions of opening, holding and supporting of the insulating multiple glazing of a traditional door.

24. A door of a refrigerated chamber cabinet comprising:

a. at least one insulating multiple glazing formed of at least one first glass sheet and one second glass sheet which are joined together by a spacer frame which holds them at a certain distance from one another, said frame extending along horizontal and vertical edges of the glazing, b. between said at least two glass sheets, at least one internal space comprising an insulating gas, that is closed by at least one first peripheral seal and one second peripheral seal on the horizontal edges and at least one peripheral seal on the vertical edges, said peripheral seals being positioned around said internal space, the spacer frame comprising at least two vertical spacers and at least two horizontal spacers, at least one vertical spacer being made of transparent resin, at least one vertical peripheral seal being transparent, the horizontal spacers being composed of at least one profile, wherein:

a) the spacers are connected together in order to form said spacer frame, b) at least one fastening system directly attaching the door to the chamber cabinet, the fastening system being at least partially inserted in at least one horizontal peripheral seal, c) the door comprises a reinforcement, attached to the fastening system and inserted at least partially in at least one horizontal peripheral seal, d) the spacer frame, the peripheral seals and the reinforcement hold the glass sheets together, and e) wherein the at least one vertical spacer is connected to the horizontal spacers by at least one stiffening element and the reinforcement and the stiffening element are the same element.

* * * * *